US008521042B2

(12) United States Patent
Yugeta et al.

(10) Patent No.: US 8,521,042 B2
(45) Date of Patent: Aug. 27, 2013

(54) IMAGE FORMING APPARATUS AND IMAGE FORMING METHOD

(75) Inventors: Satoru Yugeta, Kanagawa (JP); Masanori Kato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 12/914,808

(22) Filed: Oct. 28, 2010

(65) Prior Publication Data

US 2011/0255885 A1 Oct. 20, 2011

(30) Foreign Application Priority Data

Apr. 19, 2010 (JP) ..... 2010-096489

(51) Int. Cl.
*G03G 15/08* (2006.01)

(52) U.S. Cl.
USPC ..... 399/27; 399/223

(58) Field of Classification Search
USPC ..... 399/27, 53, 54, 222, 223, 299
See application file for complete search history.

(56) References Cited

U.S. PATENT DOCUMENTS

2008/0317506 A1* 12/2008 Furukawa ..... 399/223

FOREIGN PATENT DOCUMENTS

| | | | |
|---|---|---|---|
| JP | 2003-345101 | A | 12/2003 |
| JP | 2006-184630 | A | 7/2006 |
| JP | 2007-011151 | A | 1/2007 |
| JP | 2007-079289 | A | 3/2007 |
| JP | 2009-031412 | A | 2/2009 |

* cited by examiner

*Primary Examiner* — Hoang Ngo
(74) *Attorney, Agent, or Firm* — Sughrue Mion, PLLC

(57) ABSTRACT

A first image forming unit includes a first developing unit that develops a latent image, and a second image forming unit includes a second developing unit that develops a latent image. A transfer unit transfers an image formed by at least one of the first and second image forming units onto a recording medium. A controller performs control to form a transfer image on the recording medium through at least one of a first operation and a second operation. In the first operation, images formed by the first and second image forming units are transferred onto the recording medium as transfer images. In the second operation, the image formed by the first image forming unit is transferred onto the recording medium as a transfer image. A stopping unit stops operation of the second developing unit when the number of transfer images formed through the second operation reaches a preset value.

15 Claims, 8 Drawing Sheets

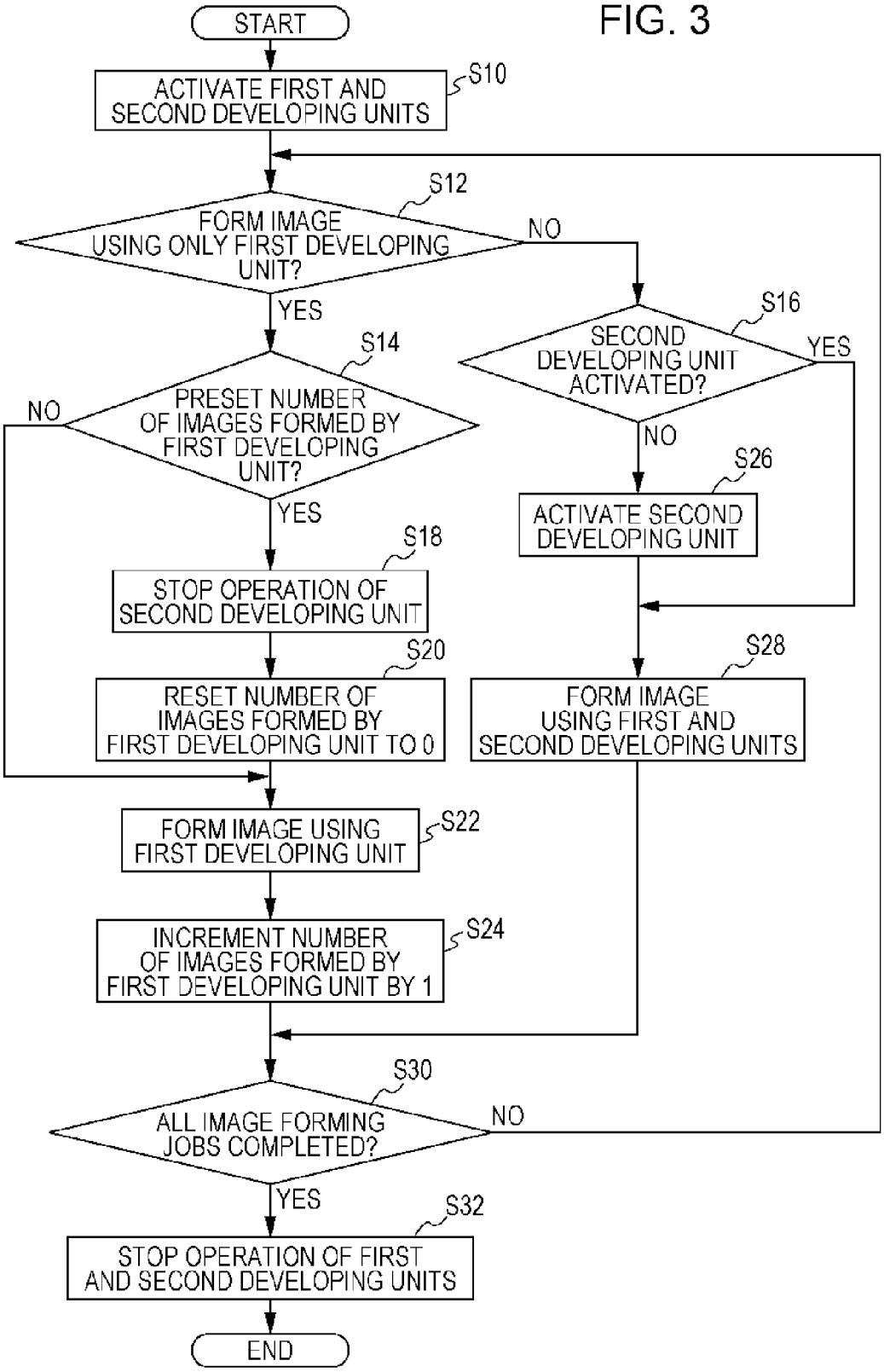
FIG. 3
START
ACTIVATE FIRST AND SECOND DEVELOPING UNITS
S10
FORM IMAGE USING ONLY FIRST DEVELOPING UNIT?
S12
NO
YES
PRESET NUMBER OF IMAGES FORMED BY FIRST DEVELOPING UNIT?
S14
NO
YES
SECOND DEVELOPING UNIT ACTIVATED?
S16
YES
NO
ACTIVATE SECOND DEVELOPING UNIT
S26
STOP OPERATION OF SECOND DEVELOPING UNIT
S18
RESET NUMBER OF IMAGES FORMED BY FIRST DEVELOPING UNIT TO 0
S20
FORM IMAGE USING FIRST AND SECOND DEVELOPING UNITS
S28
FORM IMAGE USING FIRST DEVELOPING UNIT
S22
INCREMENT NUMBER OF IMAGES FORMED BY FIRST DEVELOPING UNIT BY 1
S24
ALL IMAGE FORMING JOBS COMPLETED?
S30
NO
YES
STOP OPERATION OF FIRST AND SECOND DEVELOPING UNITS
S32
END

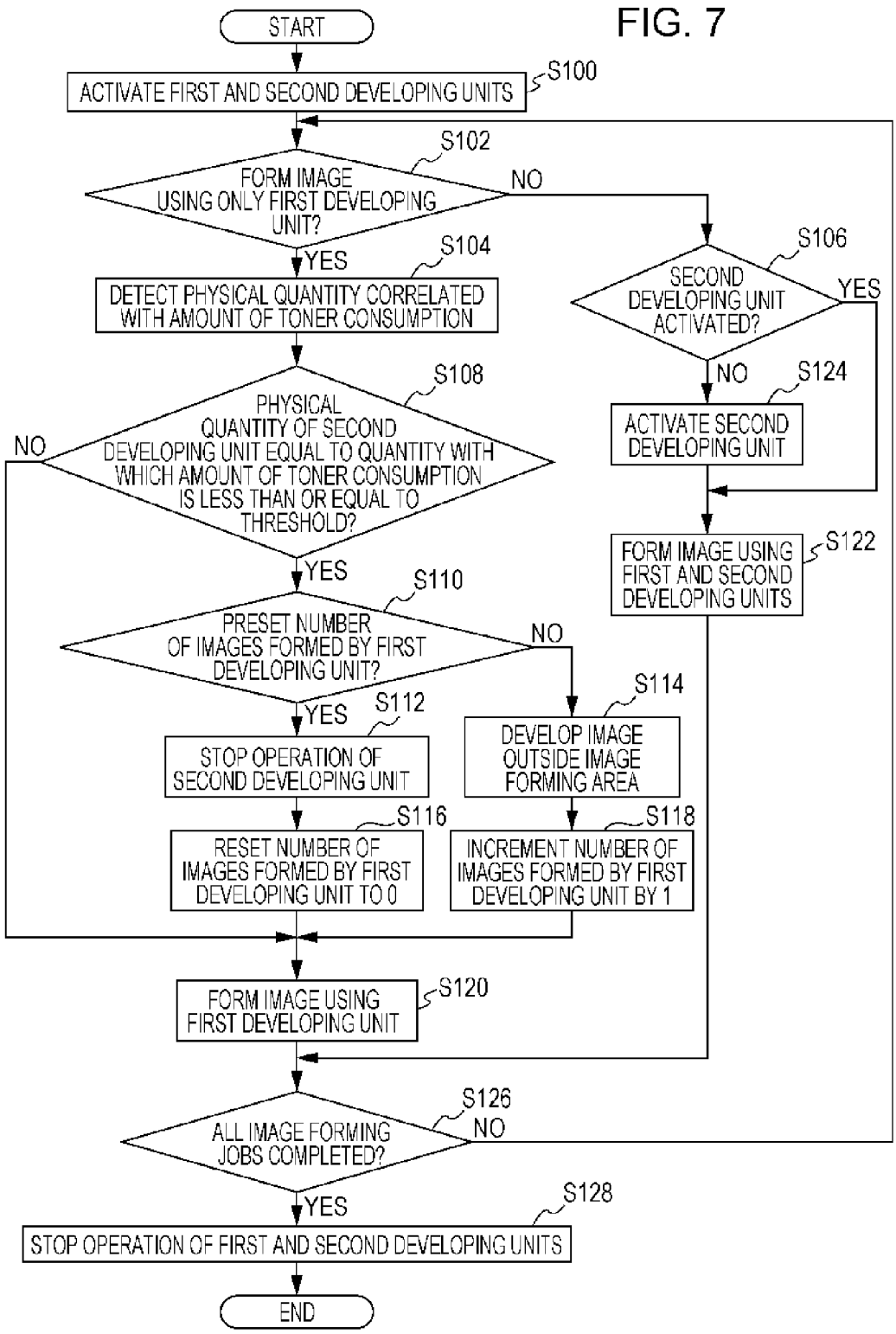
FIG. 7
START
ACTIVATE FIRST AND SECOND DEVELOPING UNITS
S100
FORM IMAGE USING ONLY FIRST DEVELOPING UNIT?
S102
NO
YES
S104
DETECT PHYSICAL QUANTITY CORRELATED WITH AMOUNT OF TONER CONSUMPTION
S106
SECOND DEVELOPING UNIT ACTIVATED?
YES
NO
S124
ACTIVATE SECOND DEVELOPING UNIT
S108
PHYSICAL QUANTITY OF SECOND DEVELOPING UNIT EQUAL TO QUANTITY WITH WHICH AMOUNT OF TONER CONSUMPTION IS LESS THAN OR EQUAL TO THRESHOLD?
NO
YES
FORM IMAGE USING FIRST AND SECOND DEVELOPING UNITS
S122
S110
PRESET NUMBER OF IMAGES FORMED BY FIRST DEVELOPING UNIT?
NO
YES
S112
S114
STOP OPERATION OF SECOND DEVELOPING UNIT
DEVELOP IMAGE OUTSIDE IMAGE FORMING AREA
S116
S118
RESET NUMBER OF IMAGES FORMED BY FIRST DEVELOPING UNIT TO 0
INCREMENT NUMBER OF IMAGES FORMED BY FIRST DEVELOPING UNIT BY 1
FORM IMAGE USING FIRST DEVELOPING UNIT
S120
S126
ALL IMAGE FORMING JOBS COMPLETED?
NO
YES
S128
STOP OPERATION OF FIRST AND SECOND DEVELOPING UNITS
END

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2010-096489 filed Apr. 19, 2010.

BACKGROUND

(i) Technical Field

The present invention relates to an image forming apparatus and an image forming method.

SUMMARY

According to an aspect of the invention, there is provided an image forming apparatus including a first image forming unit, a second image forming unit, a transfer unit, a controller, and a stopping unit. The first image forming unit includes a first holding member that holds a latent image, and a first developing unit that develops the latent image held on the first holding member using toner. The second image forming unit includes a second holding member that holds a latent image, and a second developing unit that develops the latent image held on the second holding member using toner. The transfer unit transfers an image formed by at least one of the first image forming unit and the second image forming unit onto a recording medium. The controller performs control to form a transfer image on the recording medium through at least one of a first operation and a second operation. The first operation includes transferring an image formed by the first image forming unit and an image formed by the second image forming unit onto the recording medium as transfer images. The second operation includes transferring an image formed by the first image forming unit onto the recording medium as a transfer image without allowing the second image forming unit to form a transfer image transferred onto the recording medium. The stopping unit stops operation of the second developing unit when the number of transfer images formed through the second operation reaches a preset value.

BRIEF DESCRIPTION OF THE DRAWINGS

Exemplary embodiment(s) of the present invention will be described in detail based on the following figures, wherein:

FIG. 3 is a flowchart illustrating a control method when the image forming apparatus according to the first exemplary embodiment of the present invention forms an image;

FIG. 7 is a flowchart illustrating a control method when an image forming apparatus according to a second exemplary embodiment of the present invention forms an image.

DETAILED DESCRIPTION

An example of an image forming apparatus according to a first exemplary embodiment of the present invention will be described.

Figure 1:
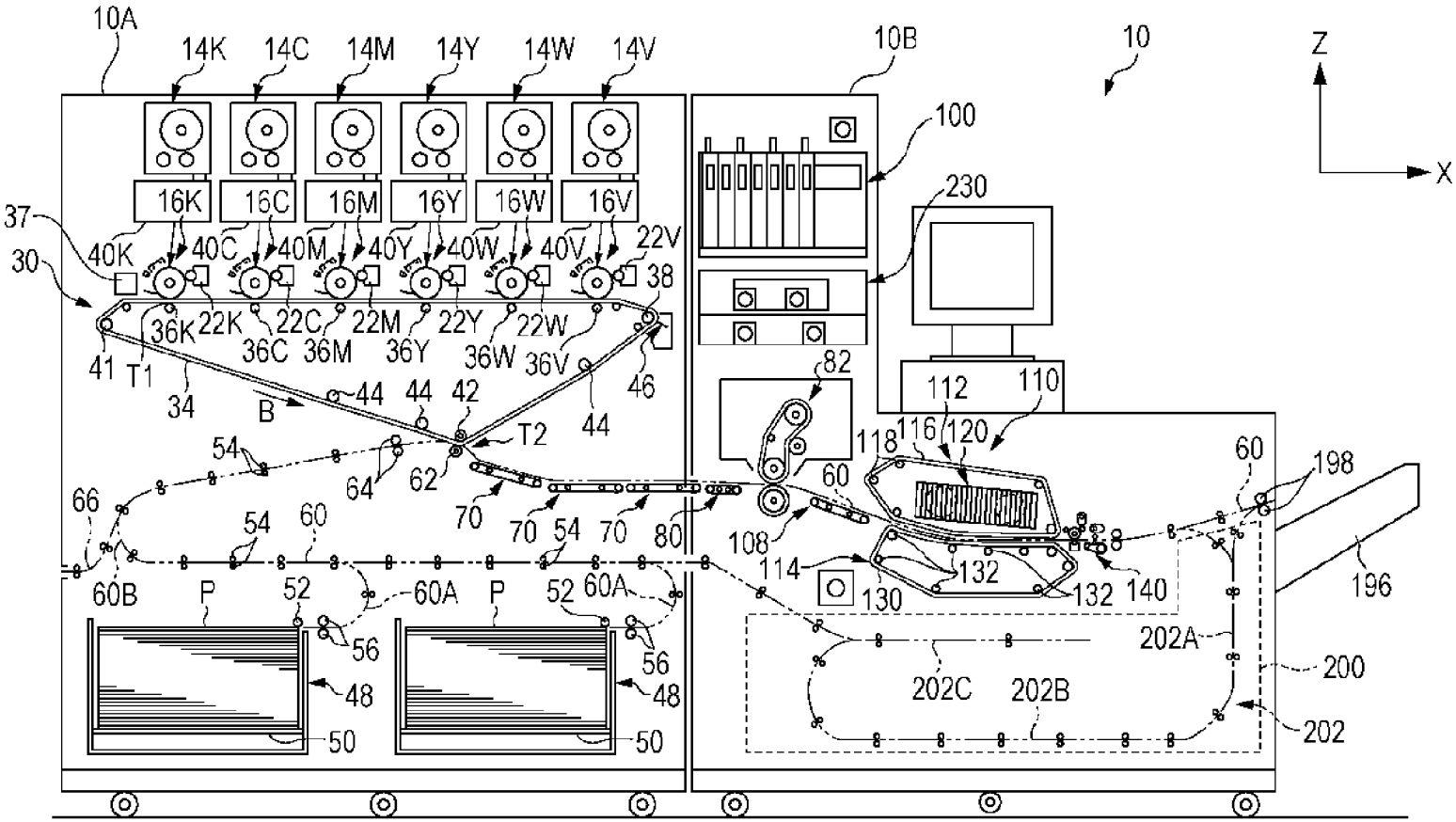
FIG. 1 illustrates the overall configuration of an image forming apparatus according to a first exemplary embodiment of the present invention.

FIG. 1 illustrates an image forming apparatus 10 according to the first exemplary embodiment. The image forming apparatus 10 may be configured to form a color image or a monochrome image, and includes a first processing unit 10A arranged on the left side as viewed in FIG. 1, and a second processing unit 10B arranged on the right side as viewed in FIG. 1 and removably attached to the first processing unit 10A. The housings of the first processing unit 10A and the second processing unit 10B are composed of plural frame materials.

An image signal processing unit configured to perform image processing on image data sent from a computer is provided inside the second processing unit 10B in the upper portion in the vertical direction (the direction indicated by an arrow Z) thereof. The image signal processing unit includes a controller 100 as an example of a controller and a stopping unit configured to perform drive control and stop control of each unit of the image forming apparatus 10. The control performed by the controller 100 will be described below in conjunction with the details of the first exemplary embodiment. Further, a power supply unit 230 is provided below the controller 100. The power supply unit 230 serves to supply power to each unit of the image forming apparatus 10 by converting an alternating current supplied from outside to a direct current.

Toner cartridges 14V, 14W, 14Y, 14M, 14C, and 14K accommodating toners (developers) of a first special color (V), a second special color (W), yellow (Y), magenta (M), cyan (C), and black (K), respectively, are provided inside the first processing unit 10A in the upper portion in the vertical direction thereof in a replaceable manner such that the toner cartridges 14V, 14W, 14Y, 14M, 14C, and 14K are located side-by-side in the horizontal direction of the first processing unit 10A. The first special color and the second special color are selected from special colors (including a transparent color) other than yellow, magenta, cyan, and black, and examples of such a special color toner include clear toner for coating an image. In the following description, the alphabets V, W, Y, M, C, and K that follow the numerals represent the individual colors V, W, Y, M, C, and K, and the numerals without the alphabets V, W, Y, M, C, and K collectively represent the colors V, W, Y, M, C, and K without distinguishing one from another. Each developer may be, for example, a two-component developer including toner and carrier.

Six image forming units 16 as an example of image forming units corresponding to the respective color toners are provided below the toner cartridges 14 side-by-side in the horizontal direction of the first processing unit 10A so as to correspond to the respective toner cartridges 14. In the first exemplary embodiment, the image forming unit 16K is an example of a first image forming unit, and the image forming units 16Y, 16M, and 16C are examples of a second image forming unit. The image forming units 16 are arranged in such a manner that the image forming units 16V, 16W, 16Y, 16M, 16C, and 16K are located in this order from upstream to downstream in the moving direction of an intermediate transfer belt 34 described below (i.e., counterclockwise in FIG. 1). Further, an exposure unit 40 for each of the image forming units 16 is provided below the corresponding one of the toner cartridges 14. Each of the exposure units 40 is configured to receive image data subjected to image processing from the controller 100 described above, and to modulate a semiconductor laser (not illustrated) in accordance with color material gradation data so that exposure light L is emitted from the semiconductor laser. More specifically, a surface of a photosensitive member 18 described below (see FIG. 2) is irradiated with exposure light L corresponding to each color to form an electrostatic latent image on the photosensitive member 18.

Figure 2:
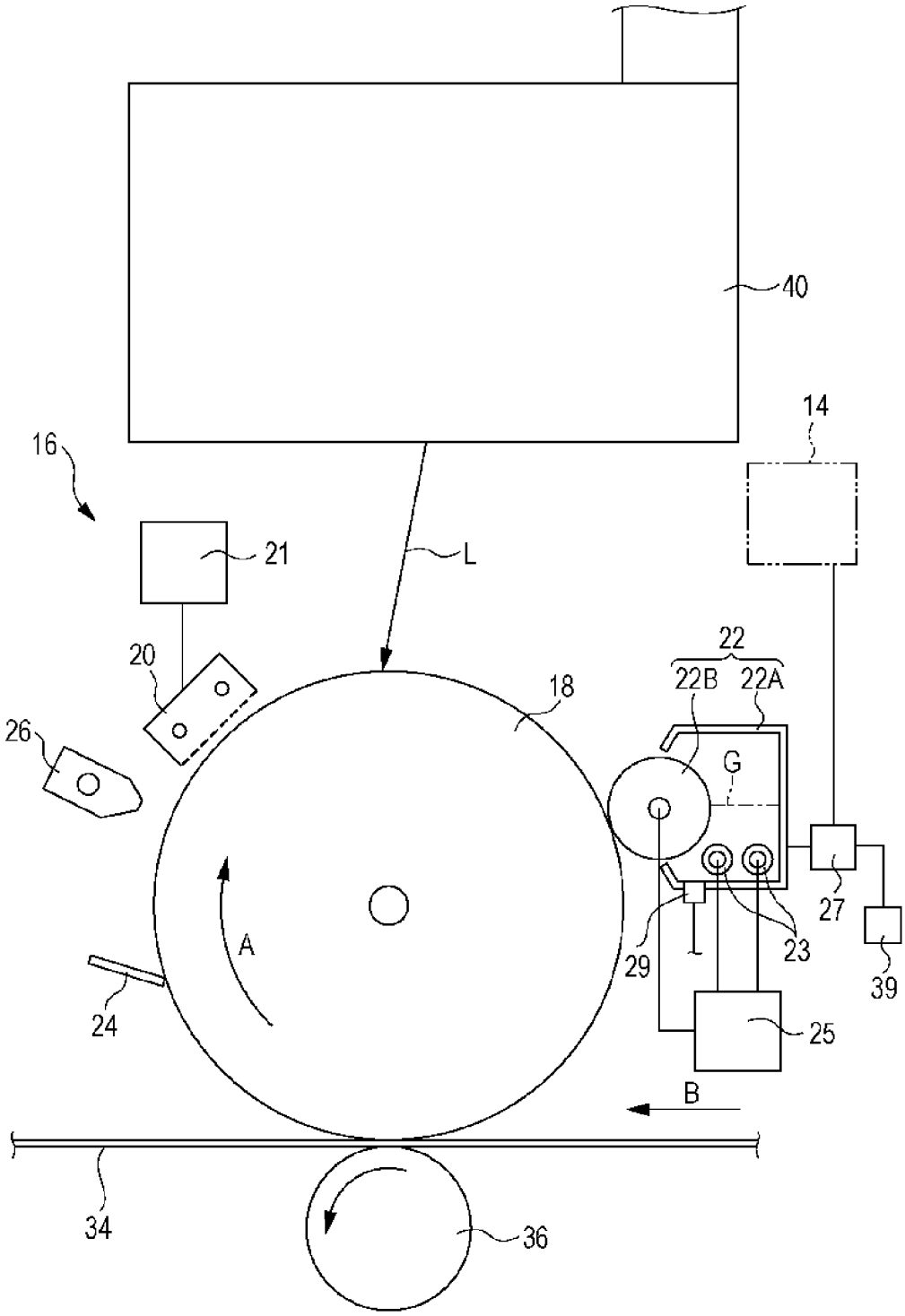
FIG. 2 illustrates the configuration of an image forming unit according to the first exemplary embodiment of the present invention.

As illustrated in FIG. 2, each of the image forming units 16 is provided with the photosensitive member 18 that is driven to rotate in the direction indicated by an arrow (clockwise in FIG. 2). In this exemplary embodiment, although not individually illustrated in FIG. 2, a photosensitive member 18K as an example of a first holding member, and photosensitive members 18Y, 18M, and 18C as examples of a second holding member are provided. A corona discharge type (non-contact charging type) charger 20 that charges the photosensitive member 18, a developing unit 22 that develops an electrostatic latent image formed on the photosensitive member 18 by the exposure light L emitted from the exposure unit 40 using the corresponding color developer (toner), a cleaning blade 24 that cleans the surface of the photosensitive member 18 after transfer, and an erase lamp 26 that irradiates the surface of the photosensitive member 18 after transfer with light to remove charge are provided around the photosensitive member 18. The charger 20, the developing unit 22, the cleaning blade 24, and the erase lamp 26 are located in this order from upstream to downstream in the rotation direction of the photosensitive member 18 so as to face the surface of the photosensitive member 18. In the first exemplary embodiment, in FIG. 1, the developing unit 22K is an example of a first developing unit, and the developing units 22Y, 22M, and 22C are examples of a second developing unit.

As illustrated in FIG. 2, a voltage applying unit 21 that applies a voltage so that the surface of the photosensitive member 18 has a set potential on the surface thereof (the charged state) is electrically connected to the charger 20. The ON/OFF state of the voltage applying unit 21 that applies a voltage to the charger 20 is controlled by the controller 100 (see FIG. 1), and the voltage applying unit 21 applies a voltage in the ON state.

The developing unit 22 is located on a side of the image forming unit 16 (in the first exemplary embodiment, on the right side in FIG. 2), and is configured to include a developer accommodating member 22A filled with a developer G containing toner, a developing roller 22B that allows the toner filled in the developer accommodating member 22A to move onto the surface of the photosensitive member 18, and two augers 23 rotatably provided inside the developer accommodating member 22A to transport the toner in a circulating manner. The developing roller 22B and the augers 23 are connected to a motor 25 via a sequence of gears provided at one end thereof, and the motor 25 is driven under the control of the controller 100 (see FIG. 1) to rotate the developing roller 22B and the augers 23. The developing roller 22B includes a cylindrical developing sleeve (not illustrated) and a magnetic member provided in the developing sleeve, and the developing sleeve rotates. Further, the developing rollers 22B of the developing units 22Y, 22M, and 22C use the motor 25 as a common (single) drive source, and the drive source of the developing roller 22B of the developing unit 22K is another motor (not illustrated) different from the motor 25.

The developer accommodating member 22A is connected to a dispenser 27. The dispenser 27 includes a pipe (not illustrated) and an auger (not illustrated) provided inside the pipe. One end of the pipe is connected to the developer accommodating member 22A, and the other end of the pipe is connected to the toner cartridge 14. Here, the dispenser 27 is configured to supply toner from the toner cartridge 14 to the developer accommodating member 22A when a motor (not illustrated) is driven by the controller 100 (see FIG. 1) to rotate the auger. The dispenser 27 is provided with a timer 39 as an example of a detector that measures (or detects) the driving time of the motor (not illustrated), and driving time information detected by the timer 39 is sent to the controller 100.

A toner density sensor 29 is provided on the bottom of the developer accommodating member 22A in such a manner that a detecting portion of the toner density sensor 29 comes in contact with the accommodated developer G. The toner density sensor 29 is configured to detect the toner density based on the magnetic permeability detected by the detecting portion, and to send obtained information about the toner density to the controller 100 (see FIG. 1).

The photosensitive member 18 and the developing roller 22B are further connected to a voltage applying unit (not illustrated) adapted to produce a potential difference between the photosensitive member 18 and the developing roller 22B. Here, the voltage applying unit applies a voltage (developing bias) to the developing roller 22B to produce a potential difference between the photosensitive member 18 connected to a ground in advance and the developing roller 22B to which the voltage is applied. Due to the potential difference, toner is moved from the outer circumferential surface of the developing roller 22B to the outer circumferential surface (the surface) of the photosensitive member 18, and is developed.

As illustrated in FIG. 1, a transfer device 30 as an example of a transfer unit is provided below the image forming units 16. The details of the transfer device 30 will be described below. Two large sheet feeder cassettes 48 that receive sheet members P as an example of a recording medium are provided below the transfer device 30 in the lower portion of the first processing unit 10A so as to be located side-by-side in the horizontal direction thereof (the direction indicated by an arrow X), and are capable of accommodating a large number of sheet members P. The two sheet feeder cassettes 48 are configured in a similar manner. Thus, one of the sheet feeder cassettes 48 will be described while the other sheet feeder cassette 48 will not be described herein.

The sheet feeder cassette 48 is configured to be taken out from the first processing unit 10A. When the sheet feeder cassette 48 is taken out from the first processing unit 10A, a bottom plate 50 that is provided in the sheet feeder cassette 48 and that is configured to place the sheet members P thereon is lowered in accordance with an instruction from a control unit (not illustrated). When the bottom plate 50 is lowered, the user is allowed to fill the sheet feeder cassette 48 with sheet members P. Further, when the sheet feeder cassette 48 is attached to the first processing unit 10A, the bottom plate 50 is raised in accordance with an instruction from the controller 100.

A delivery roller 52 is provided above one end of the sheet feeder cassette 48 to deliver the sheet members P from the sheet feeder cassette 48 to a transport path 60, and raising the bottom plate 50 brings the top sheet member P of the sheet members P stacked on the bottom plate 50 into contact with the delivery roller 52. Further, separation rollers 56 are provided downstream the delivery roller 52 in the transport direction of the sheet members P (hereinafter referred to simply as "downstream") to prevent multi-feeding of the sheet members P, and plural transport rollers 54 are provided downstream the separation rollers 56 to transport the sheet members P downstream.

The transport path 60 provided above the sheet feeder cassette 48 is configured to extend to a second transfer portion T2, which is held between a second transfer roller 62 and a support roller 42 described below, to allow the sheet members P fed from the sheet feeder cassette 48 to return at a first return portion 60A to the opposite side (to the left in FIG. 1) and further return at a second return portion 60B to the opposite side (to the right in FIG. 1).

An aligner (not illustrated) is provided between the second return portion 60B and the second transfer portion T2 to align a transported sheet member P properly, and registration rollers 64 are provided between the aligner and the second transfer portion T2 to synchronize the timing of moving a toner image (developer image) on the intermediate transfer belt 34 and the timing of transporting the sheet member P.

Further, an auxiliary path 66 extends from a side surface of the first processing unit 10A so as to merge with the second return portion 60B of the transport path 60. Thus, a sheet member P delivered from an external large-capacity collection unit (not illustrated) located adjacent to the first processing unit 10A is allowed to enter the transport path 60 through the auxiliary path 66.

Plural transport units 70 are provided downstream the second transfer portion T2 to transport a sheet member P onto which toner images have been transferred to the second processing unit 10B. The transport units 70 include plural belt members wound around driving rollers and driven rollers (not illustrated), and the driving rollers are driven to rotate to move the belt members. Thus, the sheet member P is transported downstream.

The path located downstream the transport units 70 extends from the first processing unit 10A to the second processing unit 10B, and the sheet member P delivered by the transport units 70 is received by a transport device 80 provided in the second processing unit 10B and is further transported downstream. Further, a fixing unit 82 is provided downstream the transport device 80 to fix the toner images transferred onto the surface of the sheet member P onto the sheet member P by heat and pressure.

A transport unit 108 is provided downstream the fixing unit 82 to transport the sheet member P delivered from the fixing unit 82 downstream, and a cooling unit 110 is provided downstream the transport unit 108 to cool the sheet member P heated by the fixing unit 82. The cooling unit 110 includes an upper transport unit 112 provided in the upper portion with respect to the transport path 60 of the sheet member P, a lower transport unit 114 provided in the lower portion, and a cooling section 120 having a heat sink that cools the transported sheet member P.

The upper transport unit 112 is configured to include an endless heat absorbing belt 116 that absorbs the heat of the sheet member P in contact with an image forming surface of the sheet member P and that transports the sheet member P, and plural roller members 118 that drive or support the heat absorbing belt 116 in contact with the inner circumferential surface of the heat absorbing belt 116. Here, the heat absorbing belt 116 may circulate counterclockwise in FIG. 1.

The lower transport unit 114 is configured to include an endless transport belt 130 that transports the sheet member P in such a manner that the outer circumferential surface of the lower transport unit 114 faces the heat absorbing belt 116 and is brought into the back surface of the sheet member P to press the sheet member P against the heat absorbing belt 116, and plural roller members 132 that drive or support the transport belt 130 in contact with the inner circumferential surface of the transport belt 130. Here, the transport belt 130 may circulate clockwise in FIG. 1.

A decurl processing unit 140 is provided downstream the cooling unit 110 to correct the curl of the sheet member P. Further, discharge rollers 198 are provided downstream the decurl processing unit 140 to discharge the sheet member P having an image formed on one side thereof to a discharge unit 196 disposed on a side surface of the second processing unit 10B. In order to form images on both sides of the sheet member P, the sheet member P is transported to a reverse unit 200 provided downstream the decurl processing unit 140.

The reverse unit 200 has a reverse path 202. The reverse path 202 includes a split path 202A split from the transport path 60, a sheet transport path 202B that transports the sheet member P transported along the split path 202A to the first processing unit 10A, and a reverse path 202C that provides switch-back transport of the sheet member P transported along the sheet transport path 202B by turning the sheet member P back in the opposite direction to reverse the sheet member P. With this configuration, the sheet member P switch-back transported on the reverse path 202C is transported to the first processing unit 10A, enters the transport path 60 provided above the sheet feeder cassette 48, and is delivered to the second transfer portion T2 again.

Next, the transfer device 30 will be described.

As illustrated in FIG. 1, the transfer device 30 is configured to include the intermediate transfer belt 34 that comes into contact with the photosensitive members 18 (see FIG. 2), six first transfer rollers 36 located inside the intermediate transfer belt 34 and configured to transfer toner images formed on the photosensitive members 18 onto the intermediate transfer belt 34 by multi-transfer, a driving roller 38 driven by a motor (not illustrated), a tension applying roller 41 that applies a tension to the intermediate transfer belt 34, the second transfer roller 62 that transfers the toner images from the intermediate transfer belt 34 to the sheet member P, the support roller 42 located so as to face the second transfer roller 62 with the intermediate transfer belt 34 therebetween, and plural support rollers 44.

The intermediate transfer belt 34 may be an endless member, and is wound around the six first transfer rollers 36, the driving roller 38, the tension applying roller 41, the support roller 42, and the plural support rollers 44. The intermediate transfer belt 34 includes six first transfer portions T1 (one of which is illustrated in FIG. 1) at which the toner images (developer images) are transferred from the photosensitive members 18 by the first transfer rollers 36, and the second transfer portion T2 at which the first-transferred toner images are transferred onto the sheet member P by the second transfer roller 62. The intermediate transfer belt 34 is designed to hold the toner images on the outer circumferential surface thereof and to circulate from the first transfer portions T1 to the second transfer portion T2 in the direction indicated by an arrow B (counterclockwise in FIG. 1) by using the driving roller 38.

The first transfer rollers 36 are located so as to face the photosensitive members 18 of the image forming units 16 with the intermediate transfer belt 34 therebetween. A first transfer bias voltage having a polarity opposite to the polarity of the toner is applied to the first transfer rollers 36 by a feed unit (not illustrated). With this configuration, the toner images formed on the photosensitive members 18 are first-transferred onto the first transfer portions T1 of the intermediate transfer belt 34. Furthermore, a cleaning blade 46 is provided on the opposite side of the driving roller 38 with respect to the intermediate transfer belt 34 in such a manner that the tip of the cleaning blade 46 is brought into contact with the intermediate transfer belt 34. The cleaning blade 46 is configured to remove residual toner or dust such as paper powder on the circulating intermediate transfer belt 34.

A second transfer bias voltage having a polarity opposite to the polarity of the toner is applied to the second transfer roller 62 by a feed unit (not illustrated). The sheet member P is held between the second transfer portion T2 and the intermediate transfer belt 34, and the toner images are transferred onto the sheet member P. With this configuration, the toner images of the respective colors transferred onto the intermediate transfer belt 34 by multi-transfer are second-transferred onto the sheet member P transported along the transport path 60 by using the second transfer roller 62.

Figure 4:
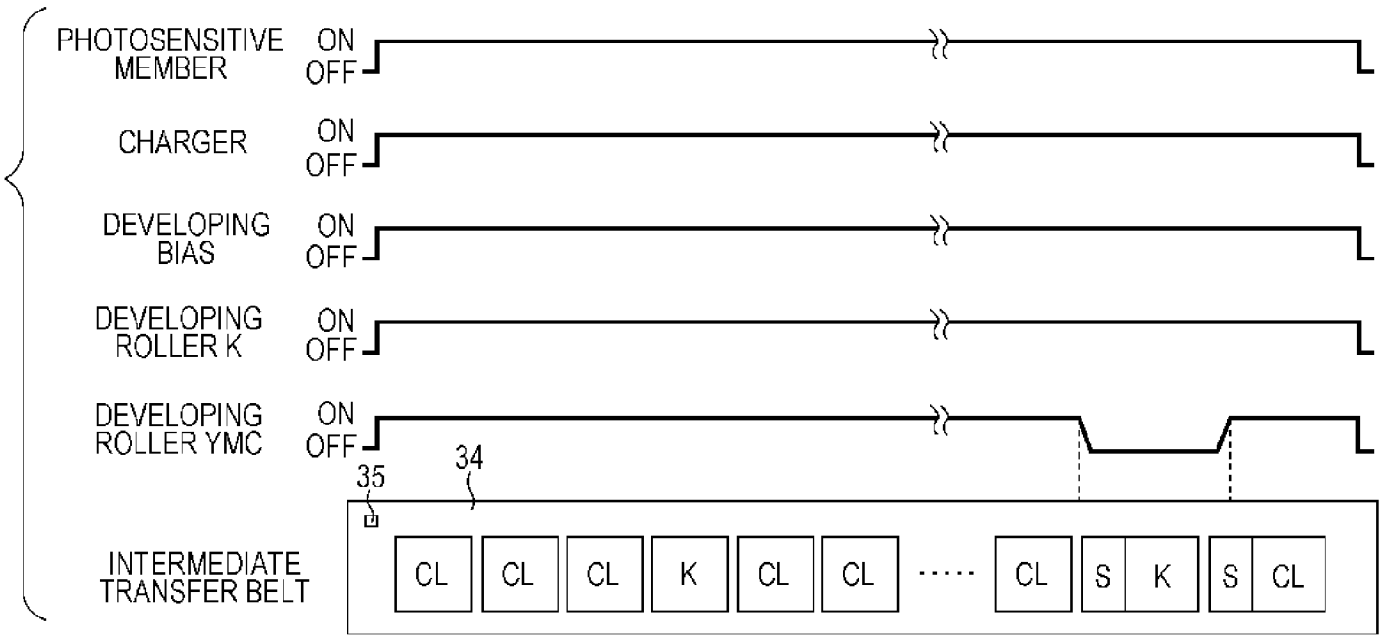
FIG. 4 illustrates the operation state of each unit of the image forming apparatus according to the first exemplary embodiment of the present invention, and images formed on an intermediate transfer belt.
Figure 5:
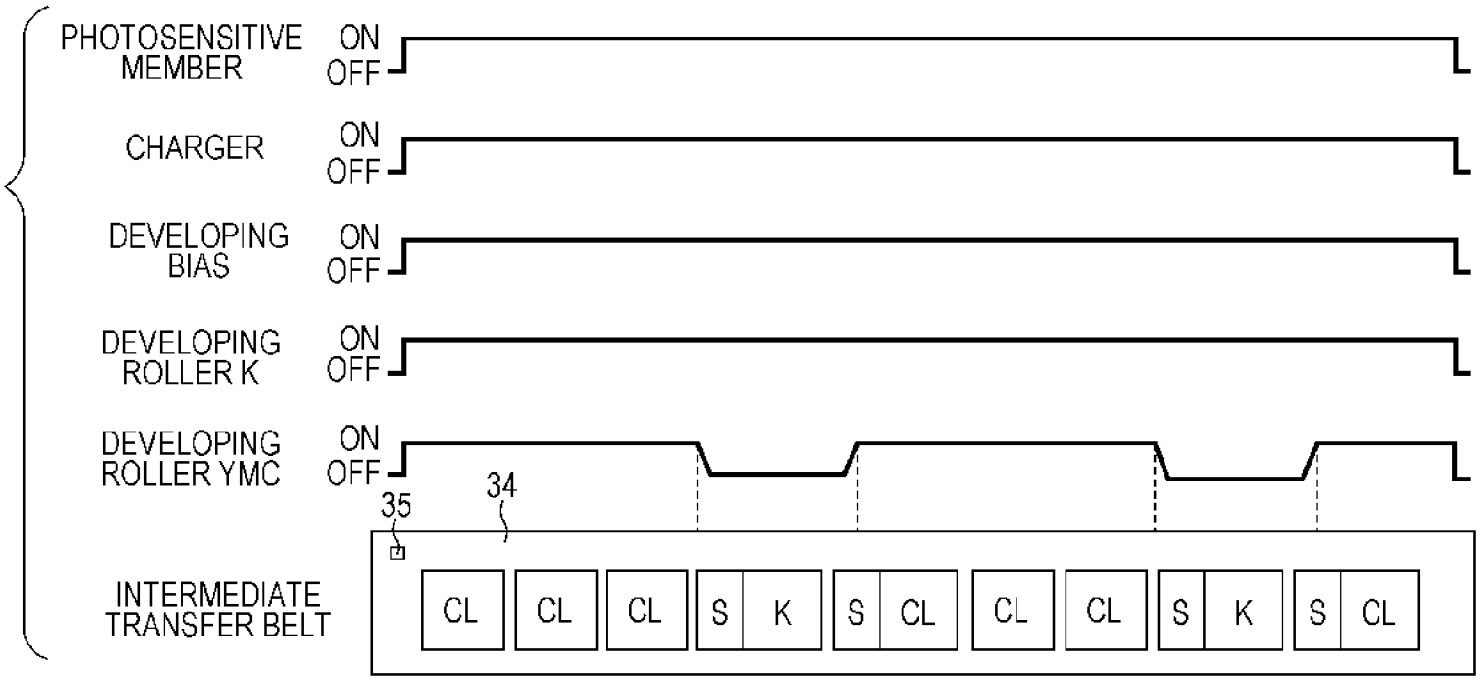
FIG. 5 illustrates the operation state of each unit of an image forming apparatus in a comparative example, and images formed on an intermediate transfer belt.

A position detection unit 37 is provided downstream the image forming unit 16K in the moving direction of the intermediate transfer belt 34 at a position facing the outer circumferential surface of the intermediate transfer belt 34 to detect a mark member 35 (see FIGS. 4 and 5) on the intermediate transfer belt 34. Here, the mark member 35 is configured to reflect light off a surface thereof, and is placed outside an image forming area of the intermediate transfer belt 34. The position detection unit 37 is configured to irradiate the surface of the intermediate transfer belt 34 with light and to detect the state of the reference position of the intermediate transfer belt 34 as to whether the reference position has moved by determining whether or not the light reflected from the mark member 35 has been received. While mark members 35 are formed in plural locations in the circumferential direction of the intermediate transfer belt 34, one mark member 35 is illustrated in FIGS. 4 and 5 but the remaining mark members 35 are not illustrated.

Here, the operation of forming an electrostatic latent image on the surface of each of the photosensitive members 18 and developing the electrostatic latent image on the surface of the photosensitive member 18 is referred to as "formation of an image" or "image formation", and the operation of transferring the developed image onto a sheet member P (recording medium) is referred to as "formation of a transfer image". Further, the controller 100 is configured to perform control to form a transfer image on the sheet member P through at least one of first and second operations in response to an instruction for successively performing the first operation and the second operation. The first operation is an operation for transferring an image formed by the image forming unit 16K and images formed by the image forming units 16Y, 16M, and 16C onto the sheet member P as transfer images. The second operation is an operation for transferring an image formed by the image forming unit 16K onto the sheet member P as a transfer image while the image forming units 16Y, 16M, and 16C do not form a transfer image that is transferred onto the sheet member P. The controller 100 also performs stop control of the developing units 22Y, 22M, 22C, and 22K.

Next, a series of image forming steps of the image forming apparatus 10 will be described.

As illustrated in FIG. 1, when each unit of the image forming apparatus 10 enters an operating state, image data subjected to image processing in the controller 100 is converted into color material gradation data of respective colors, and is sequentially output to the exposure units 40. Each of the exposure units 40 emits exposure light L in accordance with the color material gradation data of the corresponding color, and performs scan exposure on the corresponding photosensitive member 18 charged by the corresponding charger 20 (see FIG. 2). Thus, an electrostatic latent image is formed. The electrostatic latent images formed on the photosensitive members 18 (see FIG. 2) are developed as toner images of the respective colors, that is, the first special color (V), the second special color (W), yellow (Y), magenta (M), cyan (C), and black (K), by the developing units 22.

Subsequently, the toner images of the respective colors formed on the photosensitive members 18 of the image forming units 16V, 16W, 16Y, 16M, 16C, and 16K are sequentially transferred onto the intermediate transfer belt 34 by multi-transfer by using the six first transfer rollers 36V, 36W, 36Y, 36M, 36C, and 36K. The toner images of the respective colors transferred onto the intermediate transfer belt 34 by multi-transfer are second-transferred onto a sheet member P transported from one of the sheet feeder cassettes 48 by using the second transfer roller 62. The sheet member P onto which the toner images have been transferred is transported to the fixing unit 82 provided in the second processing unit 10B by using the transport units 70.

Subsequently, the toner images of the respective colors on the sheet member P are heated and pressured by the fixing unit 82 and are thus fixed onto the sheet member P. The sheet member P onto which the toner images have been fixed passes through the cooling unit 110. In the cooling unit 110, the sheet member P is transported while being held between the heat absorbing belt 116 and the transport belt 130, and the cooling section 120 cools the sheet member P. The cooled sheet member P is delivered to the decurl processing unit 140, and the curl of the sheet member P is corrected. The decurled sheet member P is discharged to the discharge unit 196 by using the discharge roller 198.

In order to form an image on a non-image surface having no image formed thereon (in the case of duplex printing), the sheet member P with an image formed on a surface thereof is delivered to the reverse unit 200 by using a switching member (not illustrated). The sheet member P delivered to the reverse unit 200 is reversed though the reverse path 202, and enters the transport path 60 provided above the sheet feeder cassette 48. Then, toner images are formed on the reverse side through the procedure described above, fixed, cooled, and then discharged to the discharge unit 196.

Next, the details of the first exemplary embodiment will be described with reference to a flowchart of FIG. 3. FIG. 3 illustrates a control flow of the controller 100.

The operation of each of the developing units 22 is controlled by the controller 100 (see FIG. 1). A method for controlling the operation of each of the developing units 22 by the controller 100 will now be described. In the first exemplary embodiment, in accordance with image data for image formation, a color image (hereinafter referred to as a "specific image") produced using the developing units 22Y, 22M, 22C, and 22K and a monochrome image (hereinafter referred to as a "non-specific image") produced using only the developing unit 22K are mixed together. Color images are produced using the Y, M, C, and K toners, and monochrome images are produced using only the K toner. Therefore, in FIG. 1, by way of example, the developing units 22Y, 22M, and 22C are selected in advance as examples of the second developing unit, and the developing unit 22K is selected as an example of the first developing unit while the developing units 22V and 22W are not used. Furthermore, image formation is performed plural times the number of which corresponds to the number of sheet members P.

As illustrated in the flowchart of FIG. 3 and FIGS. 1 and 2, when the controller 100 receives an image forming job, the processing routine is started and then proceeds to step S10. In step S10, the controller 100 activates the developing units 22Y, 22M, 22C, and 22K. That is, the motor 25 and another motor (not illustrated) for the developing unit 22K are activated, and the developing rollers 22B and the augers 23 are activated.

Then, in step S12, it is determined whether or not development is performed using only the developing unit 22K. If a positive result is determined, the processing routine proceeds to step S14. If a negative result is determined, the processing routine proceeds to step S16. In step S14, it is determined whether or not the number of images (corresponding to the number of sheet members P) formed by the developing unit 22K has reached a preset value (here, five, by way of example). If a positive result is determined, the processing routine proceeds to step S18. If a negative result is determined, the processing routine proceeds to step S22.

In step S18, the operation of the motor 25 for the developing units 22Y, 22M, and 22C, that is, the operation of the developing rollers 22B and the augers 23, is stopped. Then, the processing routine proceeds to step S20. In step S20, the count value (here, 5) of the number of non-specific images formed by the developing unit 22K is reset to 0, and then the processing routine proceeds to step S22. In step S22, the image formation (development) of a non-specific image is performed using the developing unit 22K, and then the processing routine proceeds to step S24. In step S24, the count value of the number of non-specific images formed by the developing unit 22K is added by 1 (+1), and then the processing routine proceeds to step S30.

In step S16, it is determined whether or not the developing units 22Y, 22M, and 22C have been activated. If a positive result is determined, the processing routine proceeds to step S28. If a negative result is determined, the processing routine proceeds to step S26. In step S26, the developing units 22Y, 22M, and 22C are activated. Then, in step S28, image formation is performed using the developing units 22Y, 22M, 22C, and 22K, and then the processing routine proceeds to step S30.

Then, in step S30, it is determined whether or not all the image forming jobs have completed. If a positive result is determined, the processing routine proceeds to step S32, in which the operation of the developing units 22Y, 22M, 22C, and 22K is stopped, and the image forming jobs end. If a negative result is determined, the processing routine proceeds to step S12, and the next image formation is performed in similar steps.

In this manner, if a positive result is determined in step S14, image formation is performed by the developing unit 22K while the developing units 22Y, 22M, and 22C stop their operation. If a negative result is determined, image formation is performed by the developing unit 22K without stopping the operation of the developing units 22Y, 22M, and 22C, that is, with the developing rollers 22B idling.

Here, FIG. 5 illustrates, as a comparative example, the arrangement of toner images on the intermediate transfer belt 34 when the operation of the developing units 22Y, 22M, and 22C (the developing rollers 22B) is stopped each time the image formation of a non-specific image is performed by the developing unit 22K (see FIG. 1). The ON/OFF state of rotation of the photosensitive members 18 (see FIG. 2), the ON/OFF state of application of a voltage to the chargers 20 (see FIG. 2), the ON/OFF state of application of a developing bias to the developing rollers 22B (similar in all the developing units 22), the ON/OFF state of rotation of the developing roller 22B in the developing unit 22K, and the ON/OFF state of rotation of the developing rollers 22B in the developing units 22Y, 22M, and 22C are also illustrated.

In FIG. 5, furthermore, the toner images (the leftmost is the first) on the intermediate transfer belt 34 are represented by rectangles, each corresponding to one toner image on a sheet member P. Specific images produced using the developing units 22Y, 22M, 22C, and 22K are represented by CL, and non-specific images produced using the developing unit 22K are represented by K. Since a certain amount of time may be required until the rotation of the developing roller 22B is stopped or may be required until the speed of the rotating developing roller 22B reaches a preset speed after the stopped developing roller 22B starts to rotate, it is difficult to perform next image formation for this amount of time. Thus, a skip period is required by the next image formation in the ON/OFF operation of the developing roller 22B, which is represented by S.

As illustrated in FIG. 5, the comparative example requires the skip period S at each switching from a specific image CL to a non-specific image K or from a non-specific image K to a specific image CL, resulting in lower productivity of image formation than the case where specific images CL and non-specific images K are consecutively formed without any skip period S.

In contrast, FIG. 4 illustrates, as an example of the first exemplary embodiment, the arrangement of toner images on the intermediate transfer belt 34 when the operation of the developing units 22Y, 22M, and 22C (the developing rollers 22B) is stopped once while the developing unit 22K (see FIG. 1) performs the image formation of a non-specific image K five times. In FIG. 4, a portion of the image formation of a non-specific image K that is performed five times is illustrated. The ON/OFF state of rotation of the photosensitive members 18 (see FIG. 2), the ON/OFF state of application of a voltage to the chargers 20 (see FIG. 2), the ON/OFF state of application of a developing bias to the developing rollers 22B (similar in all the developing units 22), the ON/OFF state of rotation of the developing roller 22B in the developing unit 22K, and the ON/OFF state of rotation of the developing rollers 22B in the developing units 22Y, 22M, and 22C are also illustrated. In FIG. 4, furthermore, as in FIG. 5, specific images are represented by CL, non-specific images are represented by K, and skip periods are represented by S.

As illustrated in FIG. 4, in the first exemplary embodiment, by way of example, the developing units 22Y, 22M, and 22C continue to operate while the image formation of a non-specific image K is performed until the image formation of a non-specific image K is performed five times, and no skip periods S exist. Thus, the first exemplary embodiment does not require five skip periods S while the image formation of a non-specific image K is performed six times, resulting in higher productivity of image formation than that in the comparative example. In the first exemplary embodiment, furthermore, the operation of the developing units 22Y, 22M, and 22C (the developing rollers 22B) is stopped at the time when the image formation of the sixth non-specific image K is performed. Thus, deterioration of toner may be prevented, compared with a case where the developing rollers 22B of the developing units 22Y, 22M, and 22C are constantly rotated.

Even while the developing units 22Y, 22M, and 22C stop their operation, the rotation and charging of the photosensitive members 18, the operation of the intermediate transfer belt 34, and the state of a developing bias applied are similar to those in the normal image formation operation.

Next, an example of an image forming apparatus according to a second exemplary embodiment of the present invention will be described.

The image forming apparatus according to the second exemplary embodiment may have a configuration that is mechanically the same as or similar to that of the image forming apparatus 10 according to the first exemplary embodiment described above, except for the control method of the controller 100. Thus, the image forming apparatus according to the second exemplary embodiment will be described using the image forming apparatus 10, in which substantially the same members as those of the image forming apparatus 10 according to the first exemplary embodiment described above are represented by the same reference numerals as those in the first exemplary embodiment and will not be described herein.

Also in the image forming apparatus 10 according to the second exemplary embodiment, in FIG. 1, by way of example, the developing units 22Y, 22M, and 22C are selected in advance as examples of the second developing unit, and the developing unit 22K is selected as an example of the first developing unit while the developing units 22V and 22W are not used. Furthermore, image formation is performed plural times the number of which corresponds to the number of sheet members P.

In addition to the control in the first exemplary embodiment, The controller 100 according to the second exemplary embodiment further performs control so that the operation of the second developing units 22Y, 22M, and 22C is stopped based on a physical quantity correlated with the amount of toner consumption, and control to cause the photosensitive members 18 to perform development so that toner images are transferred onto a portion outside the image forming area of the intermediate transfer belt 34.

Examples of the physical quantity correlated with the amount of toner consumption include the number of pixels of image data (area coverage), the driving time of the motor of the dispenser 27 (see FIG. 2), and the amount of change in the amount of toner which is determined by converting the toner density detected by the toner density sensor 29 (see FIG. 2) into the amount of toner. Other examples include the amount of toner converted from the image density detected by an image density sensor (for example, a sensor that converts the amount of reflection of light with which an image is irradiated into density) configured to detect the density of an image transferred onto the intermediate transfer belt 34. While the amount of toner consumption may be determined using any existing method, here, a method in which the driving time (time detected by the timer 39) of the motor of the dispenser 27 is used as a physical quantity correlated with the amount of toner consumption will be described, by way of example.

Figure 6A:
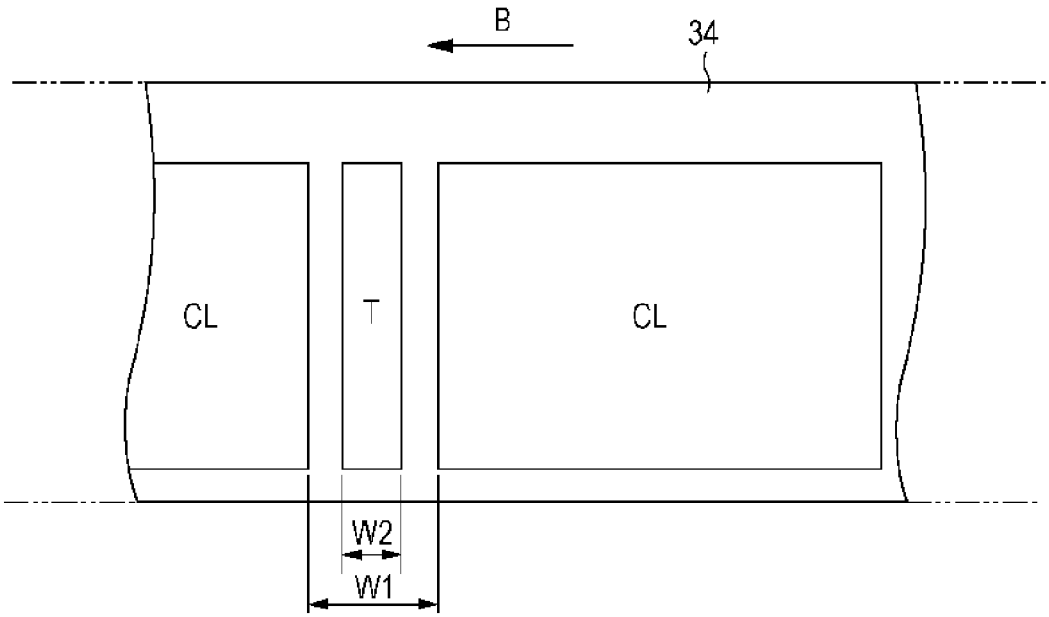
FIG. 6A schematically illustrates the state where toner is transferred between images on the intermediate transfer belt according to the first exemplary embodiment of the present invention.

Meanwhile, the control for causing the photosensitive members 18 to perform development so that toner images are transferred onto a portion outside the image forming area of the intermediate transfer belt 34 may be implemented by performing development on the photosensitive members 18 (an image formed through this development is referred to as a "toner image T") and by, as illustrated in FIG. 6A, transferring a toner image T with a width W2 (<W1) onto the intermediate transfer belt 34 between one toner image and another toner image in the moving direction (the direction indicated by the arrow B) thereof (here, by way of example, an area with an interval W1 between specific images CL). The toner image T may be transferred onto an area between a specific image CL and a non-specific image K. Since the toner image T is removed by the cleaning blade 46 (see FIG. 1) without being second-transferred onto the sheet member P, this control may serve as control for forcibly discharging toner left in the developing units 22.

Next, the details of the second exemplary embodiment will be described with reference to a flowchart of FIG. 7. FIG. 7 illustrates a control flow of the controller 100.

The operation of each of the developing units 22 is controlled by the controller 100 (see FIG. 1). A method for controlling the operation of each of the developing units 22 by the controller 100 will now be described. In the second exemplary embodiment, in accordance with image data for image formation, specific images produced using the developing units 22Y, 22M, 22C, and 22K and monochrome images produced using only the developing unit 22K are mixed together. The specific images are produced using the Y, M, C, and K toners, and the non-specific images are produced using only the K toner. Therefore, in FIG. 1, by way of example, the developing units 22Y, 22M, and 22C are selected in advance as examples of the second developing unit, and the developing unit 22K is selected as an example of the first developing unit while the developing units 22V and 22W are not used. Furthermore, image formation is performed plural times the number of which corresponds to the number of sheet members P.

As illustrated in the flowchart of FIG. 7 and FIGS. 1 and 2, when the controller 100 receives an image forming job, the processing routine is started and then proceeds to step S100. In step S100, the controller 100 activates the second developing units 22Y, 22M, and 22C and the first developing unit 22K. That is, the motor 25 and another motor (not illustrated) for the developing unit 22K are activated, and the developing rollers 22B and the augers 23 are activated.

Then, in step S102, it is determined whether or not development is performed using only the developing unit 22K. If a positive result is determined, the processing routine proceeds to step S104. If a negative result is determined, the processing routine proceeds to step S106. In step S104, the driving time of the motors of the dispensers 27 for the developing units 22Y, 22M, and 22C is detected by the timers 39 as the physical quantity correlated with the amount of toner consumption. Then, the processing routine proceeds to step S108. In step S108, it is determined whether or not the driving time of the motors of the dispensers 27 of the developing units 22Y, 22M, and 22C is a time indicating that the amount of toner consumption is less than or equal to a preset threshold. If a positive result is determined, the processing routine proceeds to step S110. If a negative result is determined, the processing routine proceeds to step S120. If the driving time of the motor of the dispenser 27 of at least one of the developing units 22Y, 22M, and 22C is a time indicating that the amount of toner consumption is less than or equal to a preset threshold, a positive result is determined. This is because the developing units 22Y, 22M, and 22C are activated by using the common motor 25.

Then, in step S110, it is determined whether or not the number of images (corresponding to the number of sheet members P) formed by the developing unit 22K has reached a preset value (here, five, by way of example). If a positive result is determined, the processing routine proceeds to step S112. If a negative result is determined, the processing routine proceeds to step S114.

In step S112, the operation of the motor 25 for the developing units 22Y, 22M, and 22C, that is, the operation of the developing rollers 22B and the augers 23, is stopped. Then, the processing routine proceeds to step S116. In step S116, the count value (here, 5) of the number of non-specific images formed by the developing unit 22K is reset to 0, and then the processing routine proceeds to step S120. In step S120, the image formation (development) of a non-specific image is performed using the developing unit 22K, and then the processing routine proceeds to step S126.

In step S114, the developing units 22Y, 22M, and 22C perform development on the photosensitive members 18, and a toner image T (see FIG. 6A) is transferred onto a portion outside the image forming area of the intermediate transfer belt 34. Thus, the toner accommodated in the developing units 22Y, 22M, and 22C that have consumed an amount of toner less than or equal to the threshold is forcibly discharged to outside, and new toner is supplied. Thus, deterioration of toner may be prevented. Then, in step S118, the count value of the number of non-specific images formed by the developing unit 22K is added by 1 (+1), and then the processing routine proceeds to step S120.

In step S106, it is determined whether or not the developing units 22Y, 22M, and 22C have been activated. If a positive result is determined, the processing routine proceeds to S122. If a negative result is determined, the processing routine proceeds to step S124. In step S124, the developing units 22Y, 22M, and 22C are activated. Then, in step S122, image formation is performed using the developing units 22Y, 22M, and 22C (here, also using the developing unit 22K), and then the processing routine proceeds to step S126.

Then, in step S126, it is determined whether or not all the image forming jobs have completed. If a positive result is determined, the processing routine proceeds to step S128, in which the operation of the developing units 22Y, 22M, 22C, and 22K is stopped, and the image forming jobs end. If a negative result is determined, the processing routine proceeds to step S102, and the next image formation is performed in similar steps.

In this manner, if a positive result is determined in step S108 and a positive result is determined in step S110, image formation is performed by the developing unit 22K while the developing units 22Y, 22M, and 22C stop their operation. If a negative result is determined in step S108 or S110, image formation is performed by the developing unit 22K without stopping the operation of the developing units 22Y, 22M, and 22C, that is, with the developing rollers 22B idling. Thus, the operation of the developing rollers 22B is not stopped until the number of non-specific images formed has reached a preset value, no skip periods S occur in image formation, resulting in improved productivity.

Furthermore, in the developing units 22Y, 22M, and 22C, if the driving time of the motors of the dispenser 27 is a time indicating that the amount of toner consumption is greater than the preset threshold, this may mean that the toner is replaced frequently. Thus, less stress may be imposed on the toner accommodated in the developing units 22 than toner that is not frequently replaced, thus preventing deterioration of toner without stopping the operation of the developing units 22Y, 22M, and 22C in step S112.

As described above, the image forming apparatus 10 according to the second exemplary embodiment may prevent reduction in productivity (or may increase productivity) when a developing unit 22 being used is changed during consecutive image formation using plural developing units 22, and may prevent deterioration of toner.

Next, an image forming apparatus according to a third exemplary embodiment of the present invention will be described.

The image forming apparatus according to the third exemplary embodiment may have a configuration that is mechanically the same as or similar to that of the image forming apparatus 10 according to the first and second exemplary embodiments described above, except for the control method of the controller 100. Thus, the image forming apparatus according to the third exemplary embodiment will be described using the image forming apparatus 10, in which substantially the same members as those of the image forming apparatus 10 according to the first exemplary embodiment described above are represented by the same reference numerals as those in the first exemplary embodiment and will not be described herein.

Also in the image forming apparatus 10 according to the third exemplary embodiment, in FIG. 1, by way of example, the developing units 22Y, 22M, and 22C are selected in advance as examples of the second developing unit, and the developing unit 22K is selected as an example of the first developing unit while the developing units 22V and 22W are not used. Furthermore, image formation is performed plural times the number of which corresponds to the number of sheet members P.

The controller 100 according to the third exemplary embodiment is different from that according to the second exemplary embodiment (see FIG. 7) in that, after the completion of image formation (after step S126), a specific operation is performed on the second developing units 22Y, 22M, and 22C for which the physical quantity corresponding to the state where the amount of toner consumption is less than or equal to a preset threshold has been detected. Further, as in the second exemplary embodiment, the physical quantity correlated with the amount of toner consumption is implemented using the driving time of the motors of the dispensers 27.

The specific operation after the completion of image formation may be one of the developing operation performed by the developing rollers 22B in the second developing units 22Y, 22M, and 22C, the operation of mixing the developers by using the augers 23, and the operation of increasing the amount of toner consumption in the subsequent image forming job. Examples of the operation of increasing the amount of toner consumption in the subsequent image forming job include resetting the toner density, and resetting the potential of the photosensitive members 18 charged by the chargers 20 by using the voltage applying units 21. Here, in the third exemplary embodiment, by way of example, the developing operation performed by the developing rollers 22B in the second developing units 22Y, 22M, and 22C may be set as the specific operation after the completion of image formation.

When the operation of mixing the developers by using the augers 23 is selected as the specific operation after the completion of image formation, non-uniform charging of the developers due to deterioration of toner may be reduced compared with the case that does not involve mixing the developers, resulting in improved quality. Further, when resetting the toner density is selected, for example, increasing the set value of toner density leads to the determination of an insufficient amount of toner in the current situation, and therefore the developing units 22 are replenished with new toner. Thus, low toner density due to the deterioration, which may be caused by no supply of new toner, may be prevented, resulting in improved quality. Further, when resetting the charged potential of the photosensitive members 18 is selected, for example, increasing the charged potential may allow an undeveloped toner image to be developed onto the surface of photosensitive member 18 by the developing roller 22B. Therefore, the amount of toner consumption is increased to reduce the amount of toner remaining in the developing units 22. Thus, deterioration of toner may be prevented.

Next, the details of the third exemplary embodiment will be described.

Figure 6B:
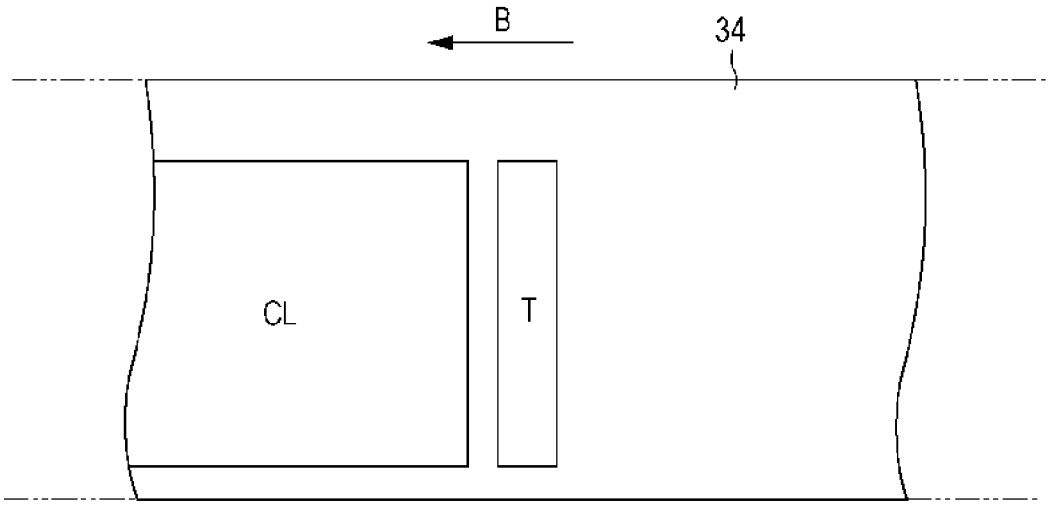
FIG. 6B schematically illustrates the state where toner is transferred after image formation on an intermediate transfer belt according to a third exemplary embodiment of the present invention.

In the third exemplary embodiment, in FIG. 7, if it is determined in step S126 that the image forming jobs end, the developing units 22Y, 22M, and 22C perform further development (development of the toner image T) after the last image formation is performed on a photosensitive member 18. Then, as illustrated in FIG. 6B, a toner image T subsequent to a toner image (here, by way of example, a specific image CL) obtained by the last image formation is transferred onto the intermediate transfer belt 34. Since the toner image T is removed by the cleaning blade 46 (see FIG. 1) without being second-transferred onto the sheet member P, the toner left in the developing units 22Y, 22M, and 22C is forcibly discharged.

In this manner, the image forming apparatus 10 according to the third exemplary embodiment may prevent reduction in productivity (increase productivity) when a developing unit 22 being used is changed during the consecutive image formation using plural developing units 22. In addition, since the accommodated toner is forcibly discharged, unused toner in the developing units 22 does not remain for a long time. Thus, deterioration of toner may be prevented.

The present invention is not limited to the foregoing exemplary embodiments.

In another exemplary embodiment, for example, the controller 100 may have set therein in advance the stop rate of the second developing units 22Y, 22M, and 22C, which is obtained when the physical quantity corresponding to the state where the amount of toner consumption exceeds a predetermined threshold is detected, and the stop rate of the second developing unit 22Y, 22M, and 22C, which is obtained when the physical quantity corresponding to the state where the amount of toner consumption is less than or equal to the threshold is detected. The stop rate of the developing units 22Y, 22M, and 22C, which is obtained when the amount of toner consumption is less than or equal to the threshold, may be greater than the stop rate obtained when the amount of toner consumption exceeds the threshold.

The stop rate is a value of the ratio M/N, where N denotes the number of non-specific images K formed in an image forming job including specific images CL and non-specific images K, and M (<N) denotes the number of times the operation of the second developing units 22Y, 22M, and 22C is stopped. That is, the stop rate refers to the ratio of the number of times the operation of the second developing units 22Y, 22M, and 22C is stopped to the number of non-specific images K formed. By way of example, the stop rate may be 60% when the amount of toner consumption is less than or equal to the threshold, the stop rate may be 20% when the amount of toner consumption exceeds the threshold, and the number of non-specific images K formed may be five. In this case, the operation of the second developing units 22Y, 22M, and 22C may be stopped three times when the amount of toner consumption is less than or equal to the threshold, and may be stopped once when the amount of toner consumption exceeds the threshold.

Figure 8A:
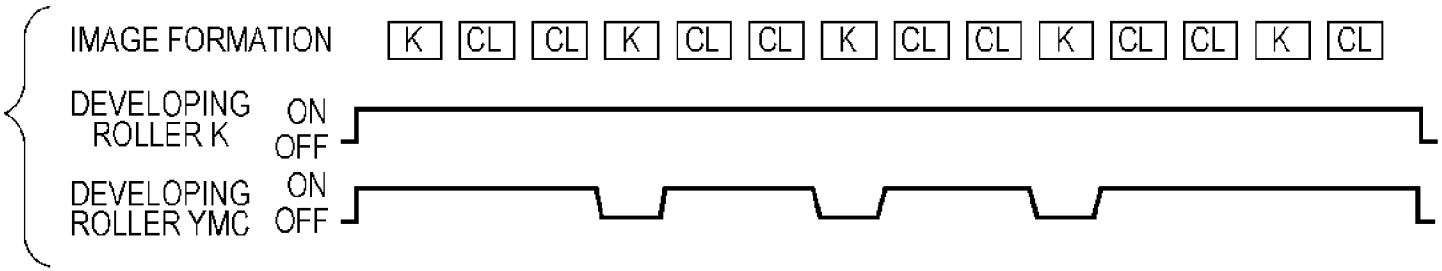
FIGS. 8A and 8B illustrate the operation state of each developing roller and images formed on an intermediate transfer belt according to another exemplary embodiment of the present invention, when the developing roller stops its operation several times out of N times and once out of N times.
Figure 8B:
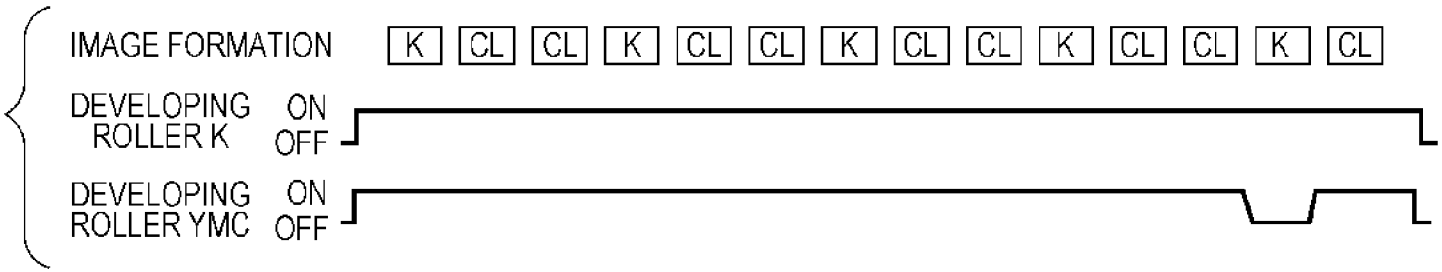

Here, when the controller 100 detects, for each of the second developing units 22Y, 22M, and 22C, a physical quantity correlated with the amount of toner consumption at during image formation (for example, the driving time of the motor of the dispenser 27). When the amount of toner consumption is less than or equal to the threshold, as illustrated in FIG. 8A, the operation of the developing rollers 22B of the second developing units 22Y, 22M, and 22C is stopped three times while the image formation of a non-specific image K is performed five times. If the amount of toner consumption exceeds the threshold, on the other hand, as illustrated in FIG. 8B, the operation of the developing rollers 22B of the second developing units 22Y, 22M, and 22C is stopped once (here, at the image formation of the fifth non-specific image K) while the image formation of a non-specific image K is performed five times.

In this manner, if the amount of toner consumption exceeds the threshold, the toner in the developing units 22 may be replaced frequently. Thus, stop of the operation of the developing units 22 may have less influence on the toner. Therefore, reducing the number of times the operation of the developing units 22 is stopped may increase productivity. If the amount of toner consumption is less than or equal to the threshold, on the other hand, due to the large amount of toner left in the developing units 22, the number of times the operation of the developing units 22 is stopped is increased to impose no or less mechanical stress on the toner accommodated in the developing units 22. Thus, deterioration of toner may be prevented.

In another exemplary embodiment, the first special color V or the second special color W may be implemented using clear toner for coating an image, and the developing units 22V and 22W may be used as second developing units. The clear toner is generally used for a large area coverage solid image, and the amount of toner consumption may be larger than that of Y, M, and C. Therefore, even if the number of times the operation of the developing units 22V and 22W is stopped is smaller than that of the developing units 22Y, 22M, and 22C, deterioration of toner may be prevented.

Furthermore, in the third exemplary embodiment, in addition to the development after the completion of image formation, as described above, one of the operation of mixing the developers by the augers 23, the operation of resetting the toner density, and the operation of resetting the charged potential of the photosensitive members 18 may be performed. In addition, a combination of the first to third exemplary embodiments may be used. For example, the formation of a toner image T between toner images may be performed and, additionally, one of operations including development after the completion of image formation, mixing the developers by the augers 23, resetting the toner density, and resetting the charged potential of the photosensitive members 18 may be performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit including a first holding member that holds a latent image, and a first developing unit that develops the latent image held on the first holding member using toner;

a second image forming unit including a second holding member that holds a latent image, and a second developing unit that develops the latent image held on the second holding member using toner;

a transfer unit that transfers an image formed by at least one of the first image forming unit and the second image forming unit onto a recording medium;

a controller that performs control to form a transfer image on the recording medium through at least one of a first operation and a second operation, the first operation including transferring an image formed by the first image forming unit and an image formed by the second image forming unit onto the recording medium as transfer images, the second operation including transferring an image formed by the first image forming unit onto the recording medium as a transfer image without allowing the second image forming unit to form a transfer image onto the recording medium; and a stopping unit that stops operation of the second developing unit when the number of transfer images formed through the second operation reaches a preset value.

2. The image forming apparatus according to claim 1, further comprising a detection unit that detects a physical quantity correlated with an amount of toner consumption of the second developing unit during image formation, wherein when the detection unit detects a physical quantity corresponding to a state where the amount of toner consumption exceeds a predetermined threshold, the preset value is set to a value larger than a value obtained when the detection unit detects a physical quantity corresponding to a state where the amount of toner consumption is less than or equal to the predetermined threshold.

3. The image forming apparatus according to claim 2, wherein the controller causes the second developing unit to perform, when the detection unit detects a physical quantity corresponding to a state where an amount of toner consumption of the second developing unit during image formation is less than or equal to the predetermined threshold, one of operations including a developing operation, an operation of mixing toner, and an operation of increasing the amount of toner consumption during subsequent image formation after completion of the image formation.

4. The image forming apparatus according to claim 1, further comprising a detection unit that detects a physical quantity correlated with an amount of toner consumption of the second developing unit during image formation, wherein when the detection unit detects a physical quantity corresponding to a state where the amount of toner consumption is less than or equal to the predetermined threshold, the second image forming unit performs development onto the second holding member so that a transfer image is transferred onto a portion outside a transfer image forming area of the recording medium.

5. The image forming apparatus according to claim 4, wherein the controller causes the second developing unit to perform, when the detection unit detects a physical quantity corresponding to a state where an amount of toner consumption of the second developing unit during image formation is less than or equal to the predetermined threshold, one of operations including a developing operation, an operation of mixing toner, and an operation of increasing the amount of toner consumption during subsequent image formation after completion of the image formation.

6. The image forming apparatus according to claim 1, further comprising a detection unit that detects a physical quantity correlated with an amount of toner consumption of the second developing unit during image formation, wherein the stopping unit has a stop rate of the second developing unit obtained when the detection unit detects a physical quantity corresponding to a state where the amount of toner consumption exceeds the predetermined threshold, and a stop rate of the second developing unit obtained when the detection unit detects a physical quantity corresponding to a state where the amount of toner consumption is less than or equal to the predetermined threshold, and wherein the stop rate of the second developing unit obtained when the detection unit detects a physical quantity corresponding to the state where the amount of toner consumption is less than or equal to the threshold is higher than the stop rate of the second developing unit obtained when the detection unit detects a physical quantity corresponding to the state where the amount of toner consumption exceeds the predetermined threshold.

7. The image forming apparatus according to claim 6, wherein the controller causes the second developing unit to perform, when the detection unit detects a physical quantity corresponding to a state where an amount of toner consumption of the second developing unit during image formation is less than or equal to the predetermined threshold, one of operations including a developing operation, an operation of mixing toner, and an operation of increasing the amount of toner consumption during subsequent image formation after completion of the image formation.

8. An image forming apparatus comprising:

a first image forming unit including a first holding member that holds a latent image, and a first developing unit that develops the latent image held on the first holding member using toner;

a second image forming unit including a second holding member that holds a latent image, and a second developing unit that develops the latent image held on the second holding member using toner;

a transfer unit that transfers an image formed by at least one of the first image forming unit and the second image forming unit onto a recording medium;

a controller that performs control to form a transfer image on the recording medium through at least one of a first operation and a second operation in response to an instruction for successively performing the first operation and the second operation, the first operation including transferring an image formed by the first image forming unit and an image formed by the second image forming unit onto the recording medium as transfer images, the second operation including transferring an image formed by the first image forming unit onto the recording medium as a transfer image without allowing the second image forming unit to form a transfer image onto the recording medium; and a stopping unit that does not stop operation of the second developing unit until the number of transfer images formed through the second operation reaches a preset value.

9. The image forming apparatus according to claim 8, further comprising a detection unit that detects a physical quantity correlated with an amount of toner consumption of the second developing unit during image formation, wherein when the detection unit detects a physical quantity corresponding to a state where the amount of toner consumption is greater than or equal to the predetermined threshold, the second developing unit is not stopped to operate.

10. The image forming apparatus according to claim 9, wherein the controller causes the second developing unit to perform, when the detection unit detects a physical quantity corresponding to a state where an amount of toner consumption of the second developing unit during image formation is less than or equal to the predetermined threshold, one of operations including a developing operation, an operation of mixing toner, and an operation of increasing the amount of toner consumption during subsequent image formation after completion of the image formation.

11. The image forming apparatus according to claim 8, further comprising a detection unit that detects a physical quantity correlated with an amount of toner consumption of the second developing unit during image formation, wherein when the detection unit detects a physical quantity corresponding to a state where the amount of toner consumption is less than or equal to the predetermined threshold, the second image forming unit performs development onto the second holding member so that a transfer image is transferred onto a portion outside a transfer image forming area of the recording medium.

12. The image forming apparatus according to claim 11, wherein the controller causes the second developing unit to perform, when the detection unit detects a physical quantity corresponding to a state where an amount of toner consumption of the second developing unit during image formation is less than or equal to the predetermined threshold, one of operations including a developing operation, an operation of mixing toner, and an operation of increasing the amount of toner consumption during subsequent image formation after completion of the image formation.

13. An image forming method comprising:

holding a latent image on at least one of a first holding member and a second holding member;

developing the latent image held on at least one of the first holding member and the second holding member using toner to form at least one of a first image and a second image;

transferring at least one of the first image and the second image onto a recording medium;

performing control to form a transfer image on the recording medium through at least one of a first operation and a second operation, the first operation including transferring the first image and the second image onto the recording medium as transfer images, the second operation including transferring the first image onto the recording medium as a transfer image without transferring the second image onto the recording medium; and stopping development of the latent image held on the second holding member when the number of transfer images formed through the second operation reaches a preset value.

14. The image forming method of claim 13, further comprising:

detecting a physical quantity correlated with an amount of toner consumption during image formation of the second image, wherein when it is detected that a physical quantity corresponding to a state where the amount of toner consumption exceeds a predetermined threshold, the preset value is set to a value larger than a value obtained when it is detected that a physical quantity corresponding to a state where the amount of toner consumption is less than or equal to the predetermined threshold.

15. The image formation method of claim 13, further comprising:

detecting a physical quantity correlated with an amount of toner consumption during image formation of the second image, wherein when it is detected that a physical quantity corresponding to a state where the amount of toner consumption is less than or equal to a predetermined threshold, the developing comprises performing development onto the second holding member so that a transfer image is transferred onto a portion outside a transfer image forming area of the recording medium.

* * * * *